US005591312A

United States Patent [19]

Smalley

[11] Patent Number: 5,591,312

[45] Date of Patent: Jan. 7, 1997

[54] PROCESS FOR MAKING FULLERENE FIBERS

[75] Inventor: Richard E. Smalley, Houston, Tex.

[73] Assignee: William Marsh Rice University, Tex.

[21] Appl. No.: 441,432

[22] Filed: May 15, 1995

Related U.S. Application Data

[63] Continuation of Ser. No. 958,929, Oct. 9, 1992, abandoned.

[51] Int. Cl.[6] ..... D01F 9/12

[52] U.S. Cl. ..... 204/157.41; 423/447.3; 423/445 B; 204/157.47; 204/173

[58] Field of Search ..... 423/445 B, 447.3, 423/DIG. 39, DIG. 40; 204/157.47, 173, 157.41

[56] References Cited

U.S. PATENT DOCUMENTS

| | | | |
|---|---|---|---|
| 4,014,980 | 3/1977 | Fujimaki et al. | 423/447.3 |
| 4,435,375 | 3/1984 | Tamura et al. | 423/447.3 |
| 4,663,230 | 5/1987 | Tennent | 428/367 |
| 4,816,289 | 3/1989 | Komatsu et al. | 423/447.3 |
| 5,227,038 | 7/1993 | Smalley | 204/173 |

FOREIGN PATENT DOCUMENTS

| | | | |
|---|---|---|---|
| 60-199921 | 10/1985 | Japan | 423/447.3 |
| 3-019919 | 1/1991 | Japan | 423/447.3 |
| 1469930 | 4/1977 | United Kingdom | 423/447.3 |

OTHER PUBLICATIONS

Bauerle, *Chemical Processing with Lasers*, pp. 5–7 (1986).

Haufler Et Al., *Journ. Phys. Chem.*, 94(24) pp. 8634–36, Nov. 29, 1990.

Koch Et Al., *Journ. Org. Chem.*, 56(14), pp. 4543–45, Jul. 5, 1991.

Haufler Et Al., *Mat. Res. Soc. Symp. Proc.*, vol. 206, pp. 627–37, Aug. 9, 1991.

Patent Abstracts of Japan for Kokai 58–104,095, first published Jun. 21, 1983.

M. Jose–Yacaman, et al. "Catalytic Growth of Carbon Microtubules with Fullerene Structure", Applied Physics Letters, vol. 62, #6, 08 Feb. 1993, pp. 657–659.

Bacon, Roger, "Growth, Structure and Properties of Graphite Whiskers," J. Appl. Phys., vol. 31, No. 2, Feb., 1960, pp. 283–290.

"Needles In A Carbon Haystack," News And Views Section, Nature, vol. 354, Nov. 7, 1991, p. 18.

Iijima, Sumio, "Helical Microtubes Of Graphitic Carbon," Nature, vol. 354, Nov. 7, 1991, pp. 56–58.

"Buckytubes," Scientific American, Dec., 1991, p. 14.

Jin, Changming, et al., "Fullerene Nanowires," Proc. of 1st Italian Workshop on Fullerenes, Bologna, Italy, Feb. 6–7, 1992.

Dresselhaus, M. S., "Down The Straight And Narrow," News and Views Section, Nature, vol. 358, Jul. 16, 1992, pp. 195–196.

Ebbesen, T. M., et al., "Large Scale Synthesis Of Carbon Nanotubes," Nature, vol. 358, Jul. 16, 1992, pp. 220–222.

*Primary Examiner*—Wayne Langel
*Assistant Examiner*—Peter Di Mauro
*Attorney, Agent, or Firm*—Baker & Botts, L.L.P.

[57] ABSTRACT

This invention provides a method and apparatus for producing fullerene fibers by establishing an electric field between a needle electrode and an opposing electrode in the presence of carbon and a heat source. Carbon is directed by the electric field to the needle electrode and heated by the heat source to form a carbon-carbon bonded fullerene network. The needle electrode may be moved to lengthen the fullerene network into a fullerene fiber. Fullerene fibers of 0.5 cm or longer may be produced by this method.

31 Claims, 4 Drawing Sheets

PROCESS FOR MAKING FULLERENE FIBERS

This application is a continuation of application Ser. No. 07/958,929, filed Oct. 9, 1992 now abandoned.

BACKGROUND OF THE INVENTION

1. Field of the Invention

This invention relates to a fullerene network of carbon and more specifically to fullerene tubes. The fullerene tubes may have a diameter of several nanometers and sufficient length to be utilized as fibers. The invention also relates to methods for making fullerene tubes and fullerene fibers.

2. Description of the Prior Art

Carbon fibers have long been known and many methods for their production have been developed, see, for example, M. S. Dresselhaus, G. Dresselhaus, K. Suglhara; I. L. Spain, and H. A. Goldberg, Graphite Fibers and Filaments, Springer-Verlag, New York (1988). However, while these conventional carbon fibers are easily made very long, the graphite sheets within their structure are either not closed tubes, or do not extend continuously along the length of the fiber, or both. The result is sharply decreased tensile strength, electrical conductivity, and chemical resistance compared with what one expects for a fiber where the carbon is bonded in a perfect fullerene network.

Fullerenes have recently been identified as the third form of pure carbon, and the only molecular form of pure carbon yet discovered, see "Fullerenes," Curl, R. F. and Smalley, R. E., Scientific American, October, 1991, pp. 54–63, incorporated herein by reference, and references cited therein.

A fullerene network can be visualized as a single sheet of graphite curled around on itself by the inclusion of 12 pentagonal ring defects in the otherwise perfect hexagonal lattice of a graphite sheet so that the edges connect to form a hollow spheroid. A fullerene network constitutes an atomic-thickness carbon membrane which is impermeable to atoms and molecules under ordinary conditions. Atoms trapped inside a fullerene network are therefore largely immune to chemical attack from the outside of the closed spheroid. The most symmetrical of these structures, ($@C_{60}$), "buckminsterfullerene" has the perfectly icosahedral structure of a soccerball, but many other forms are possible as well, such as ($@C_{70}$), which has a more elongated shape similar to a rugby ball.

Each carbon atom in an all-carbon fullerene network is bonded to three other carbon atoms. The fullerene network forms a molecule with a cage-like structure and aromatic properties. All-carbon fullerene networks contain even numbers of carbon atoms generally ranging from 20 to 500 or more.

Larger fullerenes are known as well, with many hundreds of carbon atoms bonded together in a fullerene network, and hyperfullerenes may be prepared wherein one closed fullerene network is contained within a second larger closed fullerene network, contained in turn in yet a larger closed fullerene network resulting in an onion-like structure. While these giant, hyperfullerene spheroidal carbon molecules are currently thought to be the most stable forms of fullerenes in terms of cohesive energy per carbon atom, other shapes are possible. In particular, the shape of a fullerene network can be tubular, comprising six pentagons arranged with hexagons on one end of the tube to form a hemispherical end cap connected to a long hollow tube of hexagons, and a final set of six pentagons and more hexagons connecting a second hemispherical end cap to seal the opposite end of the tube. Tubular fullerene networks within larger fullerene networks are also possible, but the tubular fullerene networks known in the prior art generally have lengths of less than 10 microns.

The molecular structure for buckminsterfullerene was first identified in 1985, see NATURE, "$C_{60}$: Buckminsterfullerene", Kroto, H. W., Heath, J. R., O'Brien, S. C., Curl, R. F. and Smalley, R. E., Vol. 318, No. 6042, pp. 162–163, Nov. 14, 1985. The process for making fullerenes described therein involves vaporizing the carbon from a rotating solid disk of graphite using a focused pulsed laser. The carbon vapor was then carried away by a high-density helium flow. That process produced generally spherical fullerenes having 60 carbon atoms although clusters of up to 190 atoms are described. Only microscopic quantities of fullerenes were produced.

The fullerene yield utilizing laser vaporization of carbon was improved by providing a temperature controlled space for the carbon atoms in the carbon vapor to combine in a fullerene structure, see, "Fullerenes with Metals Inside," Chai, et al., J. Phys. Chem., Vol. 95, No. 20, pp. 7564–7568 (1991). Chai et al. describe fullerenes having 130 carbon atoms and describe the possible coalescence of buckminsterfullerene molecules into cylindrical "bucky tubes." Chai et al. do not describe fullerene tubes having more than 200 carbon atoms and describe only coalescence triggered by a laser or an electron beam as a possible way to form the tubes.

Another method of making fullerenes was described in J. Phys. Chem. "Characterization of the Soluble All-Carbon Molecules $C_{60}$ and $C_{70}$," Ajie et al., Vol. 94, No. 24, 1990, pp. 8630–8633. The fullerenes are described as being formed when a carbon rod is evaporated by resistive heating under a partial helium atmosphere. The resistive heating of the carbon rod is said to cause the rod to emit a faint gray-white plume. Soot-like material comprising fullerenes is said to collect on glass shields that surround the carbon rod. The fullerenes described have 84 or fewer carbon atoms.

Another method of forming fullerenes in greater amounts is described in "Efficient Production of $C_{60}$ (Buckminsterfullerene), $C_{60}H_{36}$ And The Solvated Buckide Ion," Haufler, et al., J. Phys. Chem., Vol. 94, No. 24, pp. 8634–8636 (1990). The fullerenes described have 70 or fewer carbon atoms and are produced when carbon is vaporized in an electrical arc and the carbon vapor condenses into fullerenes.

Short (micron) lengths of imperfect forms of such fullerene fibers have recently been found on the end of graphite electrodes used to form a carbon arc, see T. W. Ebbesen and P. M. Ajayan, "Large Scale Synthesis of Carbon Nanotubes," Nature Vol. 358, pp. 220–222 (1992), and M. S. Dresselhaus, "Down the Straight and Narrow," Nature, Vol. 358, pp. 195–196, (16 Jul. 1992), and references therein. A similar technique was discussed by Roger Bacon, "Growth, Structure, and Properties of Graphite Whiskers," Journal of Applied Physics, vol. 31, no. 2, pp. 283–290 (1960), although the early experiments were operated at high inert gas pressures (95 atm) where thicker carbon "whiskers" are most abundant. With modern high resolution electron microscopes, and the awareness that closed carbon fullerene networks form in abundance in carbon arcs, multiwalled fullerene-like tubes were found to grow readily off the end of such graphite electrodes, and their yield at optimum pressure (near 500 torr Helium) has been found to be quite substantial. See Sumio Iijima, "Helical Microtubules of Graphic Carbon," Nature, Vol. 354, pp. 56–58, (7 Nov. 1991).

High electric fields generated on electrodes with a small radius of curvature can result in the formation of fine carbon whiskers growing out of the electrode. It has long been known that microneedles composed mostly of carbon are formed by the polymerization of hydrocarbons in the high electric field around thin wires of metals such as of tungsten, and it is known that resistively heating these metal wires to temperatures near 1200° C. during growth of the microneedles or whiskers results in a straighter, more graphitic morphology with the graphite planes somewhat aligned along the whisker axis. See B. Ajaalan, H. D. Beckey, A Maas and U. Nitschke, "Electron Microscopical Study of Pyro-Carbon Microneedles Grown by High Field Pyrolysis", Applied Physics, vol. 6, pp. 111–118 (1975). While these carbonaceous whiskers are not fullerene fibers, their production under such circumstances suggests that high electric fields may be useful.

U.S. Pat. No. 4,663,230 describes a carbon fibril having an outer region of multiple essentially continuous layers of ordered carbon atoms and a distinct inner core region, each of the layers and core disposed substantially concentrically about the cylindrical axis of the fibril. The diameter of the fibril is described as 3.5 to 70 nanometers and the length 100 times greater than the diameter.

While the above-described methods of forming fullerenes have, on occasion, formed very short tubular fullerene-like structures, the prior art does not describe any methods known for making continuous fullerene fibers of lengths longer than a few microns.

SUMMARY OF THE INVENTION

This invention provides fullerene tubes and fullerene fibers and methods for making fullerene tubes and fibers. The invention provides a way of directing carbon to the growing end of a fullerene network, and for maintaining the proper chemical and physical conditions at the growing end to insure continuous growth of the fullerene network, thereby increasing the length of the fullerene structure to dimensions not previously known. Broadly, the invention encompasses the use of a high electric field at the growing end of a fullerene fiber to help guide carbon to the most active growth sites, and to aid the activation of these sites.

In addition, the invention encompasses the use of a laser focused onto the growing end of the fullerene fiber as one means of heating the fiber growth site to an optimum temperature so that reactions at the growth site are promoted, and any defects in the fullerene network are effectively eliminated by annealing of the fullerene network bonds and/or removal of unneeded material. In order to maintain the proper conditions at the tip of the fiber as it grows, the fiber may be moved away from the growth zone so the growth site remains in the optimum position in the laser focus, and the electric field is maintained. In one embodiment, feedback mechanisms may be utilized to monitor the electric field emission current from the growing fibers and microscope optics may be utilized to monitor the scattered laser light image from the growing fiber ends to control the continuous growth of the fullerene fibers.

The carbon feedstock can be any carbon-containing molecule such as ($@C_{60}$) or another fullerene, or metallofullerene, or hydrocarbons such as benzene, toluene, xylene, ethylbenzene, naphthalene, acetylene, methane, ethane, propane, butane and higher paraffinic hydrocarbons, ethylene, propylene, butene, pentene and similar olefins and diolefins, alcohols such as methanol, ethanol, propanol, ethers, aldehydes or practically any other hydrocarbon, for instance, benzonitrile. The prior art addition of carbon atoms to a fullerene network extended the fullerene structure past the region of high electric field and the structures ceased growing. In this invention, the point of growth of the fullerene network is maintained in the proper position in the electric field to continuously attract carbon and promote its growth on end of the fullerene fiber. The positioning may be accomplished in several ways such as by moving the fullerene structure back away from the opposing electrode at substantially the same rate at which it grows. This keeps the electric field properly positioned with respect to the growing end of the fullerene structure and provides for further carbon bonding to lengthen the fullerene structure so formed. The process may be continued as long as the electric field is projected from the growing end of the fullerene structure, the energy level of the system is appropriate to promote carbon-carbon bonding, and carbon is available for bonding. The resulting fullerene fibers are substantially longer than have previously been produced.

The tubular fullerenes can be encased in yet larger fullerene tubes, and these fullerene tubes within tubes can, at least in principle, be imagined to extend may meters in length, perhaps even many kilometers. A diagram showing multiple walls and hemispherical end caps is shown in FIG. 1. Such macroscopic fullerene fibers are expected to have extremely novel and useful properties. For example, the perfect hexagonal network structure of the fullerene tube walls should give the fiber exceptionally high tensile strength, perhaps the highest possible for any material. In addition, depending on the diameter of the fullerene fibers, the number of fullerene tube walls comprised by the fiber, and the helicity of the arrangement of hexagons around the fibers' circumference, these pure carbon fibers are expected to behave as either metals or semiconductors. With addition of metals or other dopants trapped in the hollow tube down the center of a closed fullerene fiber, it should be possible to improve the electrical conductivity of these super-strong fibers.

The invention may be more fully understood by reference to the detailed description wherein reference is made to the accompanying figures.

DESCRIPTION OF THE PREFERRED EMBODIMENTS

1. The Carbon Supply

Figure 1:
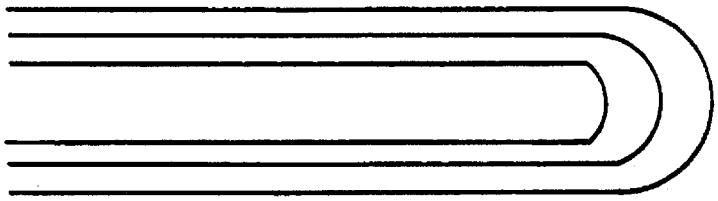
FIG. 1 is a view of one end of a fullerene fiber showing multiple walls and hemispherical end caps.

Fullerene fibers are primarily carbon, although the fullerene network which makes up the fullerene fiber may have a relatively small number of other atoms, such as boron or nitrogen, incorporated in the fullerene network. The raw material carbon used to produce fullerene fibers may be fullerenes, metallofullerenes, graphite, including carbon black, hydrocarbons, including paraffins, olefins, diolefins, ketones, aldehydes, alcohols, ethers, aromatic hydrocarbons, diamonds or any other compound that comprises carbon. Specific hydrocarbons include methane, ethane, propane, butane and higher paraffins and isoparaffins, ethylene, propylene, butene, pentene and other olefins and diolefins, ethanol, propanol, acetone, methyl ethyl ketone, acetylene, benzene, toluene, xylene, ethylbenzene, and benzonitrile. Specific metallofullerenes include ($La@C_{60}$), ($La@C_{82}$), ($La_2@C_{66}$), ($La_2@C_{106}$), ($La_2@C_{88}$), ($La_3@C_{94}$) and ($La_4@C_{110}$).

In order to produce the fullerene fibers of the invention, it is necessary to provide carbon to the growing end of a fullerene network. Carbon must be supplied in a form and manner so that it will bond to carbon already in the fullerene network of the growing fullerene fiber. Any method of providing carbon, preferably charged carbon atoms or molecules to the growth zone, is encompassed by this invention. The preferred feedstock is a pure carbon molecule such as ($@C_{60}$), ($@C_{70}$), any other fullerene, or mixtures thereof.

Several methods of producing fullerenes are known in the art. Some of the prior art is identified above and may be referenced for more detailed descriptions of specific methods of producing fullerenes. Basically, fullerenes are produced when carbon vapors are condensed in inert gas atmospheres, preferably at low pressures such as 100–500 Torr. Several methods are known in the art for producing carbon vapors, including resistive heating of carbon, laser evaporation of carbon and plasma evaporation of carbon, for instance in the evaporation of carbon utilizing an electric arc. Any method of heating carbon and vaporizing it may be utilized to form a carbon vapor.

If the carbon vapor is condensed under appropriate conditions, a fullerene network will form wherein carbon is bonded only to other carbon atoms and each carbon atom is bonded to three other carbon atoms.

The product of any fullerene generation process may be used as the carbon source for the formation of fullerene tubes. The product to be used in the subsequent fullerene tube generation may be the raw carbon soot which contains fullerenes and graphite or it may be the refined soot enriched in fullerenes. For instance, the carbon supply may comprise carbon in a mixture of forms including graphite and fullerenes generated in an electrical arc process. The raw soot produced by the arc process may be utilized as the source of carbon for this invention. Alternatively, soot produced by a laser vaporization process may be enriched in fullerenes by extractive separation, and the enriched portion could be utilized as the source of carbon for the invention. If fullerenes are utilized as the starting material, preferably the fullerenes utilized are ($@C_{60}$), ($@C_{70}$) and mixtures thereof.

Fullerenes may be utilized in either the solid or vapor phase. A carbon supply of fullerenes in the liquid phase may also be used, however, since fullerenes ($@C_{60}$) and ($@C_{70}$) sublime at the usual pressures at which they are reacted (less than one atm), a pure liquid phase is ordinarily not feasible.

Graphite is another form of carbon useful in the invention. Graphite is composed almost entirely of carbon and can therefore be used as a source of nearly pure carbon. Graphite is cheaper than fullerenes and therefore is a more economical source of carbon.

Currently a far cheaper source of carbon is provided by hydrocarbons like naphthalene, acetylene, benzene or benzonitrile. The hydrogen brought in by these hydrocarbons must be driven off the growing fullerene fiber by pyrolysis processes, primarily controlled by the intensity of the laser described below. To the extent this process is unsuccessful, the degree of perfection of the resulting fullerene fiber will suffer. Still the greater economy and ease of operating with readily available hydrocarbon molecules may lead to their preference.

Alternatively, the carbon feedstock need not be a stable molecule. It could be a carbon-containing radical of a stable molecule, or even a carbon vapor from an arc or resistively heated carbon rod or a laser heated carbon target. All that is necessary is to insure that carbon-containing molecules are provided to the growth site of fullerene fibers, and that the critical electric field direct the carbon to the growth site.

A supply of carbon that does not include fullerenes should be vaporized prior to contact with the growth site of the fullerene fiber, and any of the known methods for vaporizing carbon may be utilized. Carbon may be vaporized by an electric arc, laser evaporation or resistive heating and then directed to the growth site. Alternatively, the vapor pressure of the carbon feedstock may be higher than the system pressure, thereby providing carbon in the vapor phase. It is preferable to use carbon sources containing little or no hydrogen, and for this reason, graphite, fullerenes and mixtures thereof are preferable starting carbon materials.

The carbon source may be pure carbon to result in unsubstituted fullerene formation after vaporization. Alternatively, the carbon source may contain other materials selected to form a desired type of substituted or "doped" fullerene after vaporization. For instance, the carbon source may contain boron nitride (BN) in addition to carbon. Upon vaporization, some of the boron atoms will be incorporated into the fullerene network.

Atoms of nitrogen may be incorporated into the fullerene network by combining potassium cyanide (KCN) with carbon in the carbon source material and vaporizing the KCN concurrently with the carbon. Other sources of nitrogen may be used, for example polyacrylamide.

2. Growth Zone

As used herein, "growth zone" refers to the space where carbon is directed by an electric field to the growing end of a fullerene fiber. The growth zone encompasses the growing end of the fullerene fiber, referred to as a growth site, as well as a means for heating the growth site, such as a laser beam.

A. The electric field.

In order to produce fullerene fibers according to the invention, it is necessary to provide an electric field. The electric field directs carbon to the growth site on the growing end of a fullerene fiber. Carbon that is directed to the growth site is then added to the fullerene network, resulting in elongated fullerene fibers of the invention.

One means of providing the electric field is to supply electrical voltage to the electrically-conductive fullerene fiber and oppositely bias an opposing electrode. Either the fullerene fiber or the opposing electrode may be grounded, however, it is preferable to ground the fullerene fiber and supply negative voltage to the opposing electrode. This helps minimize or eliminate electrical discharges that might otherwise occur between the fiber and the opposing electrode. Although the actual voltage applied is rather small (1–3000 Volts), since the tip of a growing fullerene fiber is generally on the order of 1–20 nanometers in diameter, the local electric field at the tip is exceedingly strong. This is particularly true when the fullerene network of a fiber is open at the end. In this open condition, the dangling carbon bonds provide extremely reactive sites for further growth, and the local radius of curvature is on the order of 0.1 nanometer (1 Angstrom), which is sufficient to provide local electric field strengths on the order of 1–20 Volts per Angstrom (a high electric field). Such electric fields are strong enough to activate chemical reactions, and when the opposing electrode is negatively biased the electric fields also produce rapid emission of electrons by a quantum-mechanical tunneling mechanism that is highly temperature sensitive. This field emission current of electrons from the growing end of the fullerene fiber when accelerated in the electric field can ionize carbon-containing molecules in the gas phase, and the resulting positively charged carbon molecular ions will be attracted and directed by the electric field to hit the reactive growing end of the fullerene fiber. Regardless of the polarity, neutral carbon-containing molecules will also be attracted by the concentrated high electric field simply by interaction with their intrinsic polarizability or permanent dipole moment (if any) whenever they get within a few microns of the growing end of the fullerene fiber. The strong electric field therefore plays a number of useful roles simultaneously, all of which enhance growth of the fiber.

Figure 3:
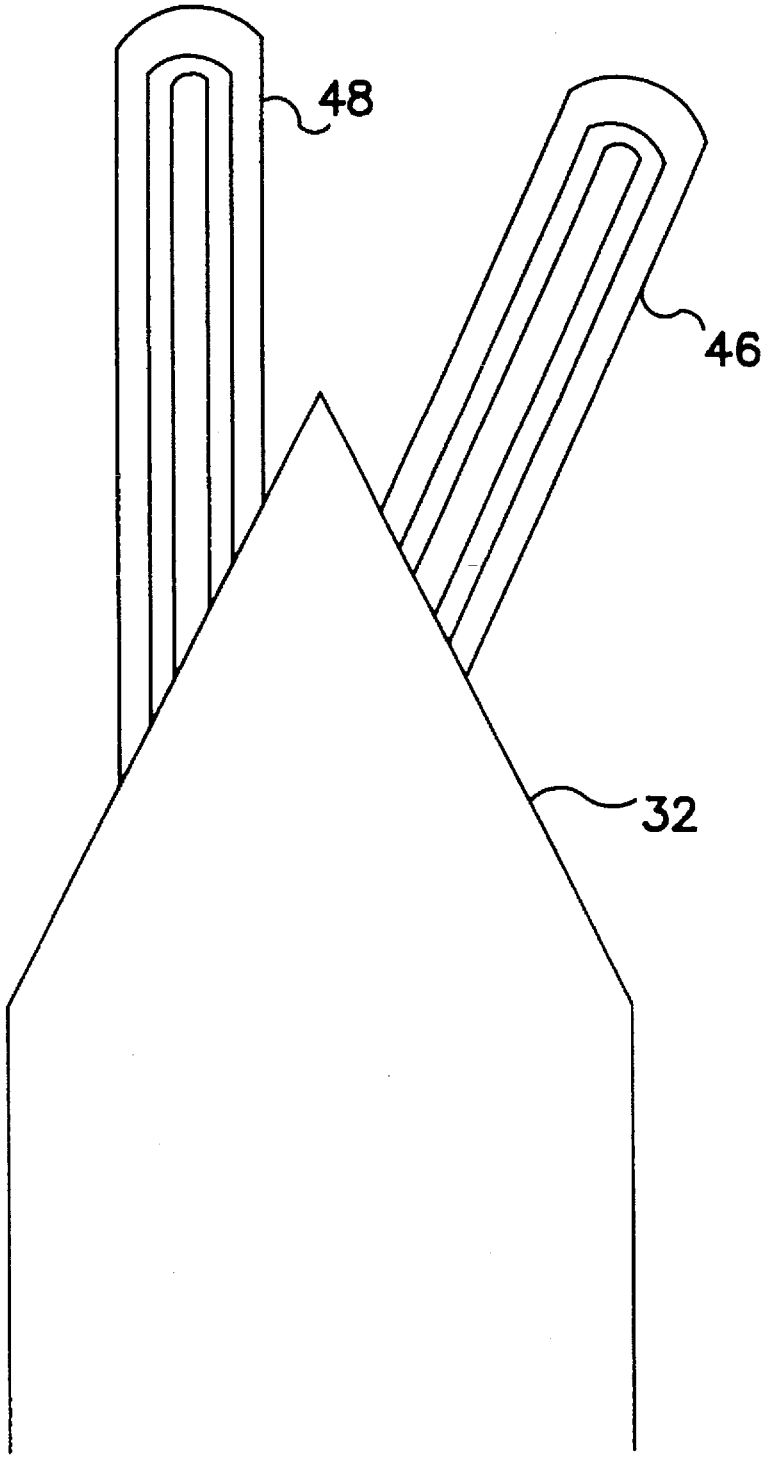
FIG. 3 shows fullerene fibers beginning to grow off of the needle electrode of FIG. 2.
Figure 4:
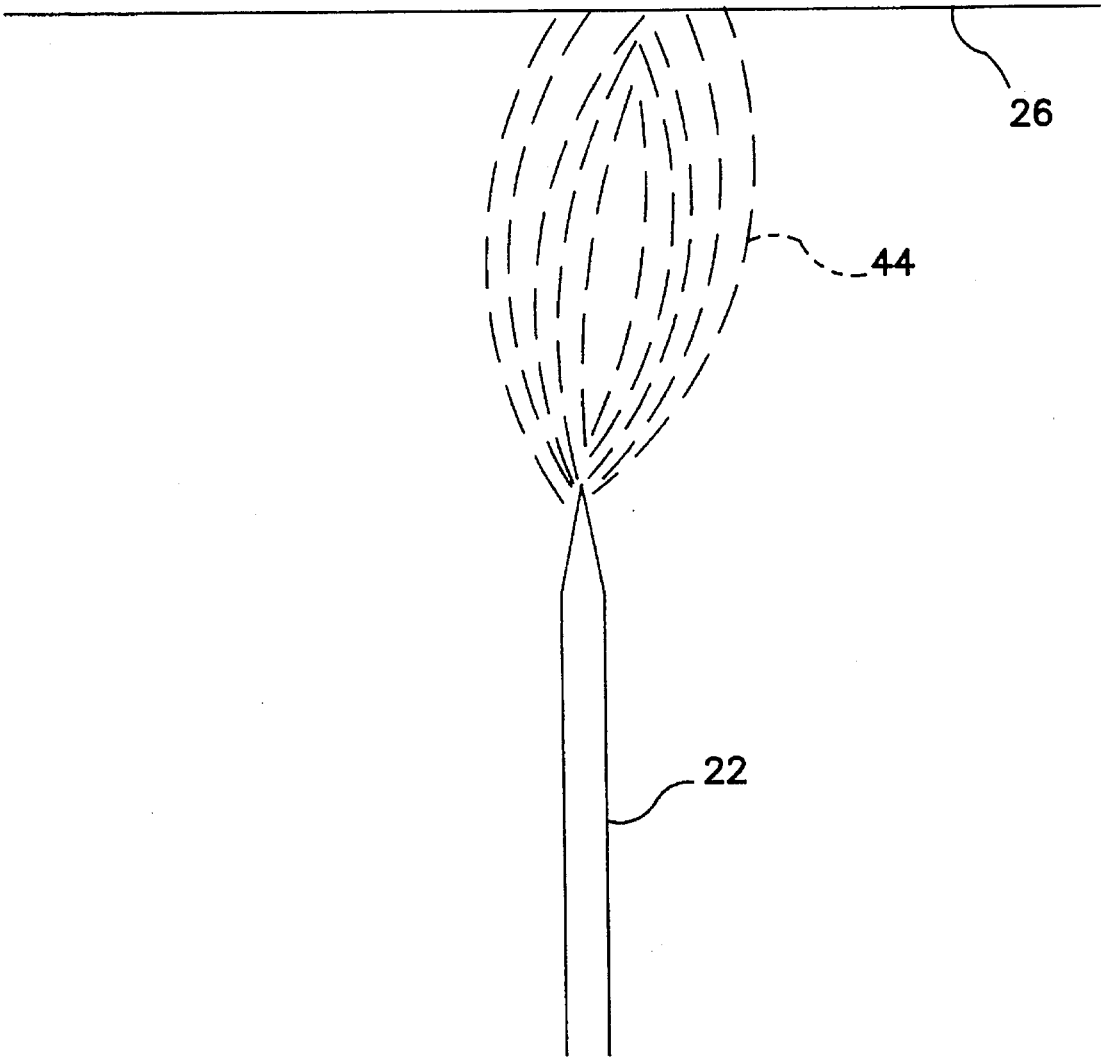
FIG. 4 shows the tip of the needle electrode and the electric field lines.

In the schematic shown in FIG. 3, the electric field is defined initially by the juxtaposition of a large (roughly 1 cm diameter) flat-bottomed steel opposing electrode across a roughly 1 mm gap from a sharp needle which serves as the initial site of growth of the fullerene fibers. To reduce discharges, the peripheral edges of the opposing electrode should be rounded. The sharp needle electrode or the growing fiber tip should be maintained as close as possible to the opposing electrode without touching. A gap of 0.1 to 5 mm, preferably about 1 mm is sufficient to produce fullerene fibers, however, better control of the needle electrode position will allow gaps of 1 to 100 microns, preferably about 10 microns. As a rule, a gap of about 10 times the diameter of the needle electrode is probably desirable. As shown in FIG. 4, the fibers grow out from the sharpened tip of this needle along the electric field lines. Generally, many fibers will grow simultaneously. Since the fullerene fibers are good electrical conductors, the electric field will emanate from their tips, and the original needle electrode may be withdrawn as the fibers grow.

Although a suitable electric field is formed if the sharp needle is either positively or negatively charged, it is presently preferable to maintain the opposing electrode negatively charged. When the needle is maintained as a negative electrode, the field emission current is high enough to disrupt the system with arc discharges. Operating with the needle as the positive electrode avoids the discharge disruptions and still provides a sufficiently strong electric field.

Initially, the fullerene network formed on the needle may consist of only 10–100 carbon atoms, but continued addition of carbon will form a larger fullerene network. After more than 100 carbon atoms are bonded in the fullerene network, the fullerene structure will resemble a tube, and if the electric field is maintained and the position of the growing end of the tube is maintained in proper relation to a heat source, the additional charged carbon atoms or molecules will be directed to the growing end of the fullerene tube.

The needle may be constructed of any material that conducts electricity, preferably metals such as tungsten and alloys thereof are utilized. Alternatively, a commercially available carbon fiber may be used as the needle electrode. The diameter of the needle electrode may range from 10 nm to 100 microns, preferably 50 to 200 nm.

If the means of positioning the sharp needle electrode is precise, the opposing electrode may also be sharpened to a point. One means of precisely positioning the sharp needle electrode is a piezoelectric drive coupled to the sharp needle electrode and a computer control system. Such systems are currently used in drive mechanisms for Scanning Tunnelling Electron Microscopes. In this embodiment, the opposing electrode may be very sharp, having a diameter of 200 nm or less, and a radius of curvature of about 1 micron. One method of making such a sharp electrode is to electrochemically etch carbon fibers available commercially. In the embodiment having two sharp electrodes, it is also preferable to reduce the voltage applied to the system, probably 10 to 100 V potentials are adequate. Also, when the sharp needle electrode is negatively biased and the opposing electrode is sharp and grounded, discharges between the two electrodes are avoided.

B. The Growth Site.

The practice of the present invention also requires the initial formation of a fullerene network which can be grown into a fullerene structure. As used herein, the term fullerene network simply means the type of carbon-carbon bonding which can be a precursor to the eventual formation of fullerenes. In order to begin the formation of the fullerene network, carbon must be provided to a growth zone and bonded together in a fullerene network. At the beginning of the process, prior to the formation of any fullerene network or fullerene structure, an initial fullerene growth site should be provided to initiate the formation of a fullerene network. It is also desirable to provide an anchor for the fullerene structure so that its position relative to the electromagnetic field and/or the carbon supply may be manipulated. Optionally, the initial fullerene growth site may also serve as the anchor. For instance, the needle tip may be utilized to provide the electric field and the anchor for the fullerene network.

C. Means For Heating the Growth Site

The fullerene growth site must be heated to a temperature sufficient to cause a reaction between the incoming carbon and the fullerene network. Any means for heating the growth site may be used, including a laser beam, or light such as concentrated sunlight. The means for heating the growth site should be capable of relatively precise aim so that the fullerene fiber, once formed, is not subsequently coated with carbon or vaporized. The means for heating the growth site should be capable of keeping the first 100 nm down the fullerene fiber from the growth site at a temperature in the range of 1000° C. to 3000° C.

One means well suited to this task is a laser beam. The laser beam may be focused on the growth site by a lens or a concave mirror. The laser beam will heat the growth site and the incoming carbon so that when they are directed together by the electric field, the incoming carbon will react with the carbon in the fullerene network at the growth site.

The wavelength of the laser should be chosen so as not to affect the carbon-containing feed molecules in the gas phase. In the case of feedstock molecules like naphthalene, an Argon ion laser operated on the 5145 Angstrom line is preferred, focused with a 10–15 cm focal length lens to a waist of roughly 50 microns in diameter, centered on the tips of the growing fibers. In the case of fullerene feedstocks such as ($@C_{60}$), a longer wavelength laser is preferred, such as Nd:YAG or titanium-sapphire laser, so that the ($@C_{60}$) molecules are not pyrolyzed before they hit the growth site of the fullerene fiber.

Alternatively, a concentrated light beam may be focused on the growth site. Sunlight may be reflected into focusing lenses and aimed at the fiber tips. In some instances, it may be preferable to filter the light to remove wavelengths that would be strongly absorbed by the carbon feedstock molecules.

D. Conditions In The Growth Zone

The temperature in the growth zone immediately around the fiber tips should generally range from 1000° C. to 2500°

C. with the exception of the growth site, where the temperature is may be higher. The carbon density is not believed critical and should range from $10^{12}$ to $10^{19}$ carbon atoms/cm $^3$. The absolute pressure of the atmosphere used to form fullerene networks may range from 0.00001, 0.0001, 0.001 or 0.01 Torr to 0.1, 1 or 10 Torr.

3. Initial Formation Of A Fullerene Network

To begin the process of forming the fullerene network, carbon must be directed to the fullerene growth zone. Some of the carbon will become charged particles because of the field emission current. The charged and uncharged carbon particles are directed by the electric field to the initial fullerene growth site. There the carbon will form into a fullerene network extending out from the initial fullerene growth site in a direction determined by the electric field. If the initial fullerene growth site is anchored to a movable substrate, the fullerene structure which begins to form may be backed out of the fullerene growth zone so that additional carbon will be directed to the growth site of the fullerene network. If the anchor is moved away from the fullerene growth zone at a rate substantially the same as the rate at which the structure grows, then a fullerene fiber of substantial length may be formed by continuing to supply carbon to the growing fullerene structure.

Figure 2:
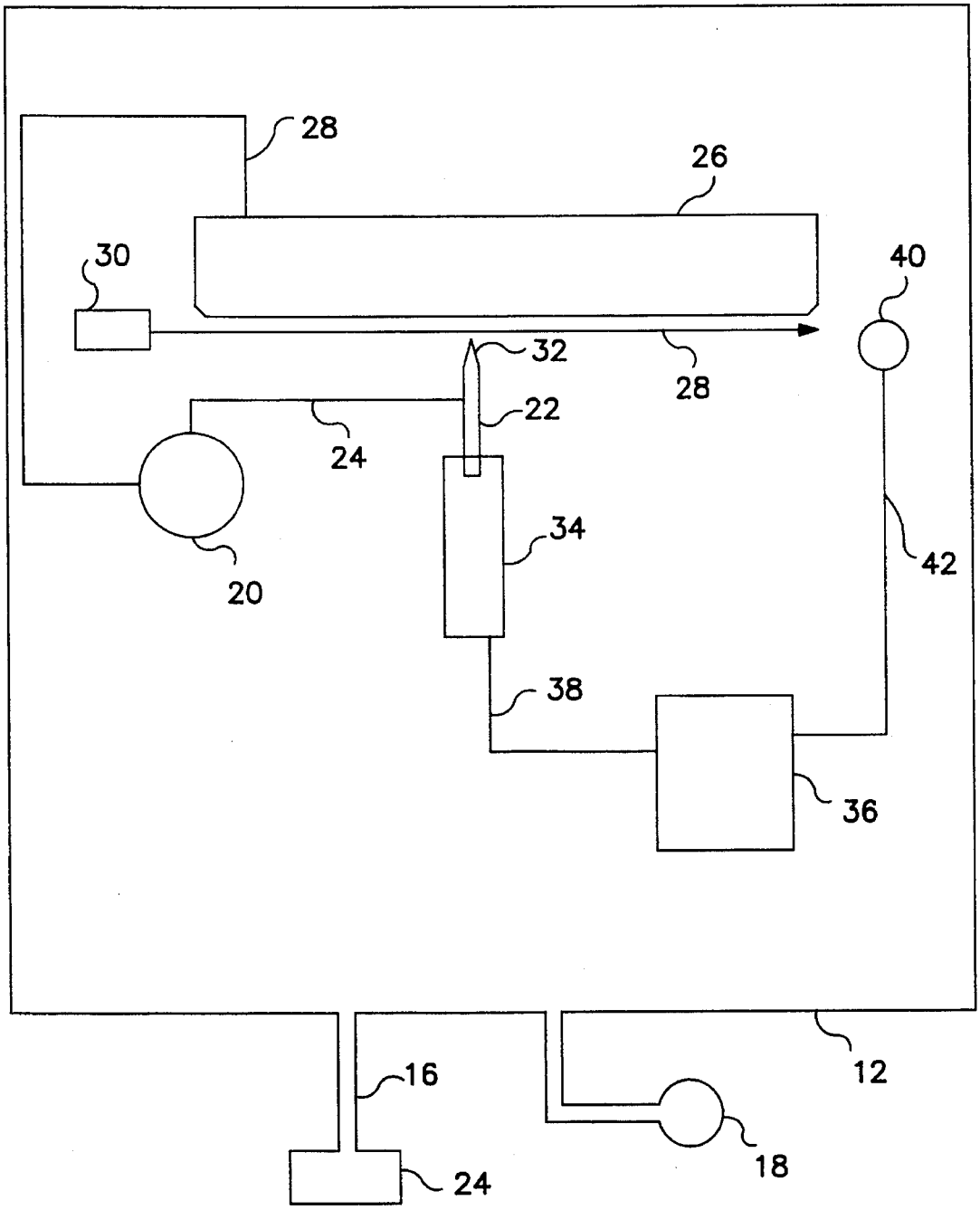
FIG. 2 is a diagram of a needle electrode an opposing electrode and the associated fiber forming equipment.

An anchor is shown in FIG. 2 as a needle point 32, which also serves as the initial fullerene growth site. Also shown in FIG. 2 is a laser beam 28 which is seen to focus at the end of the needle. This is a continuous laser beam of carefully controlled intensity and smooth, near gaussian transverse intensity profile. Its purpose is to control the temperature at the end of the growing fiber so as to optimize the growth, and to aid in the annealing and perfection of the top several tens of microns of length of the fullerene fiber.

A second heated zone known as a fullerene annealing zone may also be provided wherein the carbon atoms joined in the fullerene network in the growing fullerene structure fiber are heated so that a substantially complete fullerene network is produced. This annealing zone provides a smoothing or finishing operation to ensure that substantially all of the carbon atoms in the tube are bonded together in a fullerene network. The second heated zone may be within or outside of the growth zone and may be provided by the same or a second laser beam.

4. Growing the Fullerene Fiber

The growing end of the fullerene fiber should be maintained in the proper position within the fullerene growth zone. This may be accomplished in several ways, including anchoring the non-growing end of the fullerene fiber to an electrically conductive needle and backing the needle away from the fullerene growth zone as the fullerene fiber grows. By this method, the electric field which was initially radiating from the needle tip, will radiate from the tip of the growing fullerene fiber, since the fullerene fiber is electrically conductive. This will ensure that the electric field maintains its proper position directing the carbon to the growing end of the fiber.

In order to monitor the initiation and growth of the fibers, the net current of the field emission may be measured by connecting a picoammeter in series with the fibers as they are connected to ground potential. The voltage is applied to the opposing electrode, and therefore this electrode should be positioned much closer to the needle electrode than any other object, in order that the electric field at the fiber tips be properly defined. As the fibers grow from the needle tip, the needle should be moved to keep the growing fiber tips in proper relation to the opposing electrode and the heat source.

As the fibers grow their height above the opposing electrode is monitored optically through a microscope, looking at the scattered laser light from the fiber tips. This scattered light can be detected, although the tips themselves are generally on the order of 2–100 nanometers thick, far too thin to be viewed clearly at visible wavelengths (≈500 nanometers). Since the rate of field emission (of electrons) from the fiber tips is strongly temperature dependent, the measured field emission current is another indication of whether the fiber tips are still positioned precisely in the focus of the means for heating the growth site. Alternatively the fiber tips may be viewed through a filter to block the laser light, since the tips glow by incandescence.

In one embodiment, the needle with fibers attached, is drawn away from the laser focus by a hand-operated micrometer screw. When fiber lengths greater than 1 cm are produced, an alignment jig with a sliding electrical contact to the fibers should be provided slightly below the initial position of the needle tip to keep the fibers appropriately biased and to keep their tips centered close to the opposite electrode. With sufficient fine computer-based control of laser intensity, voltage, growth site positions, feedstock composition and pressure, continuous fiber production should be possible.

The invention may be better understood by reference to FIG. 2, where a chamber 12 encloses the fullerene fiber generating apparatus. The chamber 12 is connected with a carbon supply 14 through conduit 16. Conduit 16 may be opened or closed to control the amount of carbon present in the system. The chamber 12 is also connected with vacuum pump 18 to lower the pressure within chamber 12. A power supply 20 is electrically connected to needle 22 by electrical conductor 24. The power supply is also electrically connected with opposing electrode 26 through electrical conductor 28.

Before operation of the system, the chamber 12 is evacuated to a very low pressure and an electric field is established between needle electrode 22 and opposing electrode 26 by establishing a voltage between the two electrodes through operation of power supply 20. Preferably, the opposing electrode 26 is charged to an appropriate voltage, –2000 V, and the needle electrode 22 is connected to ground. Carbon may be introduced to chamber 12 through conduit 16 and attracted to the electric field established between needle electrode 22 and opposing electrode 26. Some of the carbon may be vaporized by laser beam 28 coming from laser power source 30 or alternatively, the carbon may be introduced to the system in a vapor state, as by introducing hydrocarbons or other carbon materials that will exist in vapor state at the low pressures involved.

After a short time, carbon fibrils will begin to form on the tip 32 of needle electrode 22. If laser power source 30 has not yet been activated, the laser beam should be activated and aimed so that the growing tips of the carbon fibrils are near or in the outer regions of laser beam 28. The heat from the laser beam will cause the tips of the growing fibers to incandesce and grow as additional carbon is drawn to the growing ends of the carbon fibrils by the electric field.

As the carbon fibrils grow toward the center of the laser beam, the needle electrode 22 should be moved to withdraw the tips of the carbon fibrils from the center of the laser beam. This may be accomplished by securing needle electrode 22 in needle electrode mount 34. The needle electrode mount 34 is adjustable to provide for movement of needle electrode 22 away from laser beam 28 and opposing electrode 26. Needle electrode mount 34 may be a micrometer which can be adjusted by hand through connections that will pass through chamber 12 or needle electrode mount 34 may be a piezoelectric device which may be controlled manually or by the use of computer control device 36. The needle electrode mount 34 is shown connected to a computer control device 36 through connector 38. The computer control device 36 should be connected to a positioning sensor 40 through connector 42. The positioning sensor 40 monitors the distance between the growing tips of the carbon fibrils and the laser beam. Utilizing the positioning sensor 40 and either computer control or manual control, the position of needle electrode 22 can be adjusted to maintain the appropriate distance between the growing tips of the carbon fibrils and the laser beam or other heat source.

In the embodiment shown in FIG. 2, many of the devices shown could be located outside of chamber 12 by including the appropriate electrical, visual, physical and other passageways through chamber 12. For instance, laser power source 30 may be located outside of chamber 12 but aimed through a passageway so that the laser beam 28 may pass into chamber 12. One of ordinary skill in the art will recognize that similar provisions may be made for power supply 20 computer controlled drive 36 positioning sensor 40 and needle electrode mount 34.

FIG. 4 is an enlarged view of needle electrode 22 juxtaposed with opposing electrode 26 showing electric field lines 44 across the gap between needle electrode 22 and opposing electrode 26.

FIG. 3 shows two fullerene fibrils 46 and 48 growing from the tip 32 of the needle electrode.

5. Doping Fullerene Fibers

Fullerene fibers having metal atoms along the longitudinal axis may also be prepared in accordance with the invention. Fibers grown from or with gas phase molecules containing metals (such as metal carbonyls or metallofullerenes) together with hydrocarbons or empty fullerenes may provide fullerene fibers with metal atoms doped in the inside cylindrical cavity. Generally, the method for making the fullerene fibers having metals is the same as the method for making fullerene fibers described above, with the addition that the desired metal atom is supplied to the fullerene growth site during formation of the fullerene network. The metal may be supplied to the fullerene growth zone in any number of ways including vaporizing the metal separately or together with the carbon. Preferably, both the metal and the carbon are supplied by fullerenes with metals inside. Representative fullerenes which may be used to include ($Ca@C_{60}$), ($La@C_{60}$), ($Y@C_{60}$), ($Sc@C_{60}$). The fullerenes with metals inside may be transferred to the fullerene growth zone in either the solid or vapor phase; however they should be in the gas phase before contact with the growing tip.

Depending upon the relative amounts of metal atoms supplied during the process, the metal atoms in the interior of the growing fullerene tube may be spaced apart by relatively long distances or they may be packed together as closely as possible. In the latter instance, an electrically conductive "nanowire" may be formed. Fibers grown from or with boron- or nitrogen-containing gas phase molecules may provide B- or N-doped fibers where some of the carbon atoms are replaced by either B or N, or both in the same fiber. Even after the fullerene fibers are grown, they can be doped later by subsequent treatments, as described herein.

6. Characterization of Fullerene Fibers

The fullerene fibers of this invention have a cross-sectional radius of 0.3 nm or more and may be single or multi-walled.

The fullerene fibers may range in length from 10 microns to lengths of more than a meter. Minimum lengths of 10, 50, 100 or 500 microns are possible with maximum lengths of 1, 2, 5 or 10 meters possible. Fibers having lengths of greater than 1 mm, or 5 mm are possible. Greater lengths are certainly possible and within the scope of the invention, the length of the fullerene fiber being mainly limited by the amount of carbon material available to add to the growing end of the fullerene fiber, and the time available for preparing the fullerene fiber. Therefore, fibers of 100 kilometers or more could be made according to this invention. The fullerene fibers may be produced in extremely long lengths of thousands of meters in order to produce tiny electrically conducting wires.

7. Manipulation of the Fullerene Fibers

Both the doped and undoped fullerene fibers may be manipulated in substantially the same manner. Fullerene fibers may be passed through a heating zone to anneal the layer or layers of carbon forming the fullerene network to form substantially complete fullerene networks. This annealing process may be necessary to remove some of the imperfections which may result during the growth of the fullerene fiber. The annealing preferably occurs at temperatures of 1000° to 2900° C. It may be preferable to complete the annealing in the substantial absence of hydrogen atoms especially hydrogen atoms on the inside of the fullerene fiber structure. The atmospheres mentioned in the literature as useful for forming fullerenes are also useful for annealing the fullerene tubes.

Fullerene fibers cut in inert gas environments are expected to self heal on their ends, particularly if laser-irradiated, or exposed to a high flux electron beam. The fullerene fibers may be severed in an atmosphere that is non-reactive with the fullerene network and the ends of the two severed pieces will automatically heal by forming carbon-carbon bonds. Closed fibers of any desired length may therefore be formed from bulk supplies of longer fullerene fibers. The fullerene fibers may also be severed in a hydrogen rich environment thereby enabling the hydrogen to passivate the dangling bonds in order to leave the severed end of the fiber open. This method may be utilized to provide access to the interior of the fiber to allow the addition or removal of particular atoms. Fullerene fibers cut under water or other reactive fluid may be passivated in the open state before they have a chance to close. Such fibers when cut at either end will then be nanometer-scale graphite pipes. These may then be filled with small molecules or ions, or—depending on their internal size—solutions, and then resealed by cutting and "cauterizing."

The fullerene fibers may also be effectively welded together simply by aiming two separate fiber ends toward each other and then charging each fiber oppositely. The opposite charges will align the fibers properly allowing them to be joined together by forming carbon-carbon bonds between the two fullerene fibers in order to result in one single fiber. Alternatively, two separate fullerene fibers may be aimed at each other in an atmosphere rich with other fullerene molecules such as ($@C_{60}$) or ($@C_{70}$) and aiming a laser beam at the gap between the two fullerene fibers. Similar methods may be used to join three fullerene fibers together in order to effectively form a "Y" joint in the fullerene fibers. Other methods of welding may utilize an electron beam or STM voltage to provide the energy necessary to join two or more fibers together. It may also be possible to join one end of a fullerene fiber to its own other end thereby forming a fullerene ring.

EXAMPLE

The following example will help illustrate the invention. A commercially available carbon fiber produced by pyrolizing polyacrylonitrile (PAN) was mounted on a micrometer inside a vacuum chamber. The carbon fiber was mounted so adjustment of the micrometer would change the position of the carbon fiber relative to the opposing electrode. The carbon fiber was electrically connected to ground and the vacuum chamber was evacuated to a pressure of $10^{-6}$ Torr with a tubopump. The free tip of the carbon fiber was brought to about 1 mm away from the center of a 1 cm diameter opposing stainless steel electrode electrically biased to −2000 V.

A 100 milliwatt argon ion laser beam focused to a 50 micron spot was aimed to pass about 50 microns above the tip of the carbon fiber, thereby heating the carbon fiber to incandescence. This was viewed through a microscope, having a red filter to remove the light of the laser. Naphthalene was charged to the vacuum chamber and the pressure adjusted to about 20 millitorr. After about 10 minutes, new small fibrils began to grow off the end of the original carbon fiber.

The laser beam was then positioned beneath the tips of the fibrils and gradually brought up to the tips of the fibrils until the tips began to incandesce. The tips of the fibrils appeared to grow to the laser beam. The micrometer was adjusted to withdraw the fibril tips from the laser beam to keep the fibril tips away from the center of the laser focus.

Over the next 2 hours, fibrils continued to grow with frequent branching. At the end of about 2 hours, the fibrils had grown to lengths of several millimeters. All the fibril branches were connected to the original carbon fiber through a single strand from the base of the fibril all the way to the end, resembling a jagged bolt of lightning. A scanning electron microscope image revealed the fibril diameter was about 100 nm to 150 nm. Tunnelling electron microscopy revealed that the fibril comprised a central crystalline core having a diameter of about 60 nm, and the outer layer was amorphous. The crystalline core diffracted the electron beam of the microscope in a way that indicated graphite sheets aligned along the axis of the fibril. The thickness of the amorphous coating appeared to correlate with the rate of fibril withdrawal, the slower the rate of withdrawal, the thicker the amorphous coat. Fibrils produced in this manner have reached lengths of 0.5 cm. It is expected that the conditions of fullerene fiber formation can be optimized to produce longer, straighter fibrils with negligible branching.

I claim:

1. A process for making a carbon fiber comprising one or more fullerene tubes, comprising:

(a) establishing an electric field between a needle tip and an opposing electrode;

(b) providing vaporized carbon to the space around the electric field to form a growing carbon-containing precursor for fullerene which precursor contains carbon-carbon bonds that have a fullerene structure on the needle tip;

(c) focusing a laser beam between the growing precursor and the opposing electrode; and (d) withdrawing the needle tip from the opposing electrode while maintaining the electric field between the growing precursor and the opposing electrode and while providing vaporized carbon to the space around the electric field to form said carbon fiber.

2. A process in accordance with claim 1 wherein the needle tip and the growing precursor are electrically biased to ground.

3. A process in accordance with claim 2 wherein the electric field is maintained at a pressure of less than 0.001 Torr.

4. A process in accordance with claim 3 wherein the vaporized carbon is provided to the space around the electric field by introducing a carbon feedstock comprising paraffins, olefins, aromatics, alcohols, ethers, esters, aldehydes, ketones, alkynes or mixtures thereof to the space around the electric field.

5. A process in accordance with claim 4 wherein the carbon feedstock is anthracene.

6. A process in accordance with claim 3 wherein the vaporized carbon is provided to the space around the electric field by introducing a carbon feedstock comprising graphite to the space around the electric field.

7. A process in accordance with claim 3 wherein the vaporized carbon is provided to the space around the electric field by introducing a carbon feedstock comprising fullerenes to the space around the electric field.

8. A process in accordance with claim 7 wherein the carbon feedstock consists essentially of fullerenes.

9. A process in accordance with claim 8 wherein the fullerenes are selected from the group of ($La@C_{60}$), ($La@C_{82}$), ($La_2@C_{66}$), ($La_2@C_{88}$), ($La_3@C_{94}$), ($@C_{60}$), ($@C_{70}$) and mixtures thereof.

10. A process in accordance with claim 3 wherein the carbon feedstock comprises boron or nitrogen.

11. A process for making carbon fibers comprising one or more fullerene tubes, which comprises:

(a) introducing carbon to a fiber growth site comprising an electric field and a laser beam for heating the growth site;

(b) guiding the carbon with the electric field to said growth site;

(c) reacting at least a portion of the carbon guided to the growth site into a carbon-containing precursor for fullerene which precursor contains carbon-carbon bonds that have a fullerene structure to form said carbon fiber; and (d) maintaining the growth site positioned in the laser beam.

12. A process in accordance with claim 11, wherein the growth site is maintained positioned in the means for heating a growth site by manipulating the relative position of the fiber.

13. A process for making fullerene tubes comprising:

(a) providing a fullerene tube nucleation zone maintained in an electric field, (b) providing a needle tip and a laser beam within the fullerene tube nucleation zone, c) providing carbon to the fullerene tube nucleation zone under conditions sufficient to form a carbon-containing precursor for fullerene which precursor contains carbon-carbon bonds that have a fullerene structure, having a first end anchored to the needle tip and a second end open for bonding to additional carbon, and (d) withdrawing the needle tip from the fullerene tube nucleation zone to maintain the second end within the laser beam in the fullerene tube nucleation zone.

14. A process for making a carbon fiber comprising one or more fullerene tubes, comprising:

(a) establishing an electric field between an initial fullerene growth site and an opposing electrode;

(b) focusing a laser beam between said initial fullerene growth site and the opposing electrode;

(c) providing vaporized carbon to a space around the electric field to form a growing carbon-containing precursor for fullerene which precursor contains carbon-carbon bonds that have a fullerene structure on said initial fullerene growth site; and (d) withdrawing said initial fullerene growth site from the opposing electrode while maintaining the electric field between the growing precursor and the opposing electrode and while providing vaporized carbon to the space around the electric field to form said carbon fiber connected to said initial fullerene growth site.

15. A process in accordance with claim 14 wherein said initial fullerene growth site is a needle tip.

16. A process in accordance with claim 14 wherein said initial fullerene growth site is a carbon fiber.

17. A process in accordance with claim 14 wherein said laser beam is initially focused to heat said initial fullerene growth site and is maintained focused on the growing precursor as said initial fullerene growth site is withdrawn from the opposing electrode.

18. A process for making a carbon fiber comprising one or more fullerene tubes, comprising:

(a) establishing a high electric field having strength of 1 to 20 volts per Angstrom between a needle tip and an opposing electrode in the absence of an electrical discharge;

(b) providing vaporized carbon to the space around the high electric field to form a growing carbon-containing precursor for fullerene which precursor contains carbon-carbon bonds that have a fullerene structure on the needle tip; and (c) withdrawing the needle tip from the opposing electrode while maintaining the high electric field between said growing precursor and the opposing electrode and while providing vaporized carbon to the space around the high electric field to form said carbon fiber.

19. A process in accordance with claim 18 wherein the needle tip and the growing precursor are electrically biased to ground.

20. A process in accordance with claim 19 wherein the high electric field is maintained at a pressure of less than 0.001 Torr.

21. A process in accordance with claim 20 wherein the vaporized carbon is provided to the space around the high electric field by introducing a carbon feedstock comprising paraffins, olefins, aromatics, alcohols, ethers, esters, aldehydes, ketones, alkynes or mixtures thereof to the space around the high electric field.

22. A process in accordance with claim 21 wherein the carbon feedstock is anthracene.

23. A process in accordance with claim 20 wherein the vaporized carbon is provided to the space around the high electric field by introducing a carbon feedstock comprising graphite to the space around the high electric field.

24. A process in accordance with claim 20 wherein the vaporized carbon is provided to the space around the high electric field by introducing a carbon feedstock comprising fullerenes to the space around the high electric field.

25. A process in accordance with claim 24 wherein the carbon feedstock consists essentially of fullerenes.

26. A process in accordance with claim 25 wherein the fullerenes are selected from the group of ($La@C_{60}$), ($La@C_{82}$), ($La_2@C_{66}$), ($La_2@C_{88}$), ($La_3@C_{94}$), ($@C_{60}$), ($@C_{70}$) and mixtures thereof.

27. A process in accordance with claim 20 wherein the carbon feedstock comprises boron, nitrogen or mixtures thereof.

28. A process in accordance with claim 18 wherein a laser beam is focused between the growing precursor and the opposing electrode.

29. A process for making carbon fibers comprising one or more fullerene tubes, which comprises:

(a) introducing carbon to a carbon fiber growth site comprising an electric field having a field strength of 1 to 20 volts per Angstrom and a means for heating the growth site comprising a laser beam or light as the heat source;

(b) maintaining the electric field to prevent electrical discharges therein;

(c) guiding the carbon with the electric field to said growth site;

(d) reacting at least a portion of the carbon guided to the growth site into a carbon-containing precursor for fullerene which precursor contains carbon-carbon bonds that have a fullerene structure to form said carbon fiber; and e) maintaining the growth site positioned in the means for heating said growth site.

30. A process in accordance with claim 29 wherein the growth site is maintained positioned in the means for heating a growth site by manipulating the relative position of the fiber.

31. A process in accordance with claim 29 wherein the means for heating a growth site is a laser beam.

* * * * *